United States Patent [19]

Anton et al.

[11] Patent Number: 4,737,204

[45] Date of Patent: Apr. 12, 1988

[54] HEAT TREATMENT GIVING A STABLE HIGH TEMPERATURE MICRO-STRUCTURE IN CAST AUSTENITIC STAINLESS STEEL

[75] Inventors: Donald L. Anton, Toland; Franklin D. Lemkey, Windsor, both of Conn.

[73] Assignee: The United States of America as represented by the United States Department of Energy, Washington, D.C.

[21] Appl. No.: 917,461

[22] Filed: Oct. 10, 1986

[51] Int. Cl.[4] ..... C22C 37/06

[52] U.S. Cl. ..... 148/325; 148/326; 420/57; 420/101

[58] Field of Search ..... 148/136, 327, 326, 325, 148/324; 420/56.12, 57, 101

[56] References Cited

U.S. PATENT DOCUMENTS

| | | | |
|---|---|---|---|
| 2,839,391 | 6/1958 | Loveless | 420/56 |
| 3,165,400 | 1/1965 | Ray et al. | 420/12 |
| 3,366,972 | 1/1968 | Tanczyn et al. | 420/56 |
| 3,420,660 | 1/1969 | Kawahata et al. | 448/326 |
| 3,615,920 | 10/1971 | Tolento | 148/136 |
| 3,925,064 | 12/1975 | Takamura et al. | 420/57 |

*Primary Examiner*—Christopher W. Brody
*Attorney, Agent, or Firm*—William W. Randolph; Judson R. Hightower; Richard E. Constant

[57] ABSTRACT

A novel micro-structure developed in a cast austenitic stainless steel alloy and a heat treatment thereof are disclosed. The alloy is based on a multicomponent Fe-Cr-Mn-Mo-Si-Nb-C system consisting of an austenitic iron solid solution ($\gamma$) matrix reinforced by finely dispersed carbide phases and a heat treatment to produce the micro-structure. The heat treatment includes a pre-braze heat treatment followed by a three stage braze cycle heat treatment.

11 Claims, 9 Drawing Sheets

1065 °C/30 min/WO $R_c = 42$

1065 °C / 30min / AC
788 °C / 16hr / AC
650 °C / 16hr / AC

760°C/20 hr/AC
1065°C/30 min/AC

10μm

760 °C/20 hr/AC
1065 °C/30 min/AC
790 °C/16 hr/AC

10μm

760 °C / 20 hr / AC
1065 °C / 30 min / AC
790 °C / 16 hr / AC
650 °C / 16 hr / AC 10μm 1150°C/10 hr/AC
1065°C/30 min/AC
790°C/16 hr/AC
650°C/16 hr/AC
$R_c = 41$ 50μm 10μm

HEAT TREATMENT GIVING A STABLE HIGH TEMPERATURE MICRO-STRUCTURE IN CAST AUSTENITIC STAINLESS STEEL

BACKGROUND OF THE INVENTION

The present invention relates to a novel micro-structure developed in a cast austenitic stainless steel alloy and a braze cycle heat treatment thereof. Specifically, the present invention is directed to an alloy based on a multicomponent Fe-Cr-Mn-Mo-Si-Nb-C system which consists of an austenitic iron solid solution ($\gamma$) matrix reinforced by finely dispersed carbide phases and a braze cycle heat treatment to produce this micro-structure.

Austenitic stainless steels are most commonly composed of 12–28 wt% chromium and 4–22 wt% nickel additions which impart corrosion resistance far superior to common steels as well as stabilize the face-centered cubic (FCC) lattice. These stainless steels are commonly strengthened by solid solution mechanisms as well as by precipitation of $Cr_{23}C_6$ carbides as a fine dispersion. These carbides which are initially coherent with the FCC matrix coarsen rapidly upon exposure to elevated temperatures in excess of 650° C. This exposure to elevated temperatures weakens the micro-structure and limits their use at temperatures well below 650°.

A need exists for a low-cost cast iron-based alloy that meets the requirements of high strength and thermal fatigue resistance to approximately 800° C., compatibility and low permeability with hydrogen, elevated temperature oxidation-corrosion resistance, and contains a minimum amount of strategic elements.

The present invention thus addresses the development of a cast iron-based alloy in combination with other low-cost low strategic value elements such as manganese, silicon and carbon and avoids the additions of cobalt or nickel. Because of the high carbon levels (greater than 1.0 wt%), chromium additions can be made using high-carbon ferro-chromium derived from chromite deposits in the Western United States. Until recently, these chromite deposits had been considered too low grade for use in the manufacture of stainless steel because of their lower chromium-to-iron ratios of 1.5:1 and their higher carbon content.

SUMMARY OF THE INVENTION

Accordingly, it is an object of the present invention to provide a novel cast austenitic stainless steel which overcomes the above-noted disadvantages.

A further object of the present invention is to produce a novel cast austenitic stainless high carbon steel which allows age hardening and extends the high temperature strength well beyond current stainless steel limits.

Another object of the present invention is to develop a low-cost cast iron-base alloy micro-structure that can be used for metal Stirling engine cylinder heads and regenerator housing components.

Yet another object of the present invention is to produce an iron-base alloy which has high strength and thermal fatigue resistance to over 800° C.

Still another object of the present invention is to produce an iron-base alloy which is compatible and has low permeability with hydrogen.

It is yet another object of the present invention to produce a cast iron-base alloy which has superior elevated temperature oxidation corrosion resistance.

It is a further object of the present invention to produce a cast iron-base alloy which contains a minimum number of strategic elements.

Still a further object of the present invention is to provide a braze cycle heat treatment which produces a novel micro-structure of this iron-base alloy, thus allowing for component fabrication while yielding material of sufficient strength.

These and other objects of the present invention are fulfilled by first providing a cast austentic stainless steel alloy comprising about 13–17 percent chromium, about 13–17 percent manganese, about 1.5–2.5 percent molybdenum, about 1.0–2.0 percent carbon, about 0.5–1.5 percent niobium, about 0.5–1.5 percent silicon, with the balance being iron. A high temperature prebraze heat treatment followed by a braze cycle heat treatment impart a stable high temperature micro-structure with high strength to the resulting cast austenitic stainless steel article. The cast alloy is subjected to a standard braze cycle heat treatment which includes a first heat treatment at about 1040°–1090° C. for about 20–40 minutes followed by cooling, a second optional heat treatment at about 765°–815° C. for about 14–18 hours followed by cooling, and a third optional heat treatment at about 635°–675° C. for about 14–18 hours followed by cooling. The last two stages of the braze cycle heat treatment basically are useful for strengthening the material to which the alloy of the present invention is being brazed. In one aspect of the present invention, this standard braze cycle heat treatment is preceded by an underage prebraze treatment which comprises heat-treating the cast alloy at about 735°–785° C. for about 18–22 hours. In a second aspect of the present invention, the standard braze cycle heat treatment is preceded by an overage prebraze heat treatment, which comprises heat treating the cast alloy at about 1125°–1175° C. for about 8–12 hours.

The alloy preferably contains about 15% chromium, about 15% manganese, about 2% molybdenum, about 1.5% carbon, about 1% niobium, about 1% silicon, with the balance being iron.

In the standard braze cycle heat treatment, the first stage heat treatment is preferably conducted at about 1065° C. for about 30 minutes, the second stage heat treatment is preferably conducted at about 790° C. for about 16 hours, and the third stage treatment is preferably conducted at about 650° C. for about 16 hours.

The underage prebraze heat treatment preferably occurs at about 760° C. for about 20 hours followed by cooling. The overage prebraze heat treatment preferably occurs at about 1150° C. for about 10 hours followed by cooling.

The present alloy can be brazed to a precipitation hardening stainless steel, such as CG-27. CG-27 is used for heat exchanger tubing.

The prebraze heat treatments are employed to enhance the high temperature properties of the alloy after brazing. The as-cast hardness of the alloy is typically $33R_c$. However, the rapid age hardening occurring as a result of the present heat treatment results in a stable micro-structure with a hardness in the range of from $44–46R_c$. This large increase in hardness is due to a cubic or plate-like precipitate of $M_{23}C_6$ and a fine plate-like phase. The fine plate-like precipitate phase strengthens the matrix and is resistant to coarsing at elevated temperature.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1A:
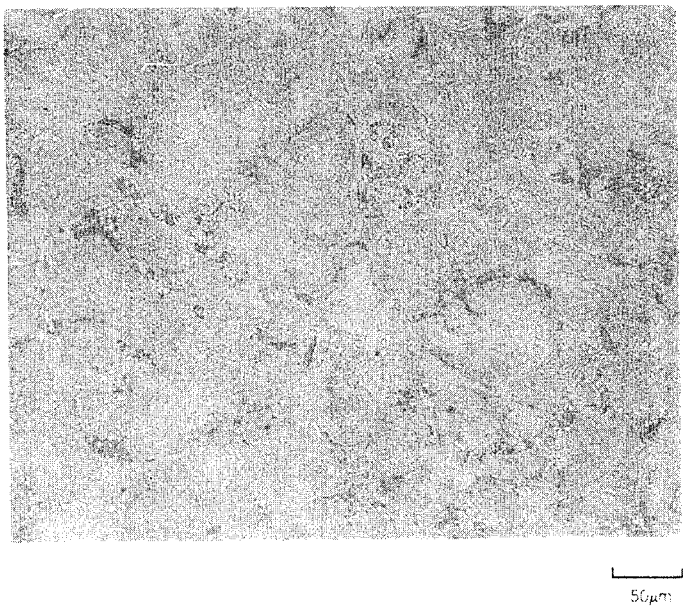
FIG. 1 is an optical micrograph of the as-cast alloy after it has been subjected to the first stage of the standard braze cycle heat treatment.
Figure 1B:
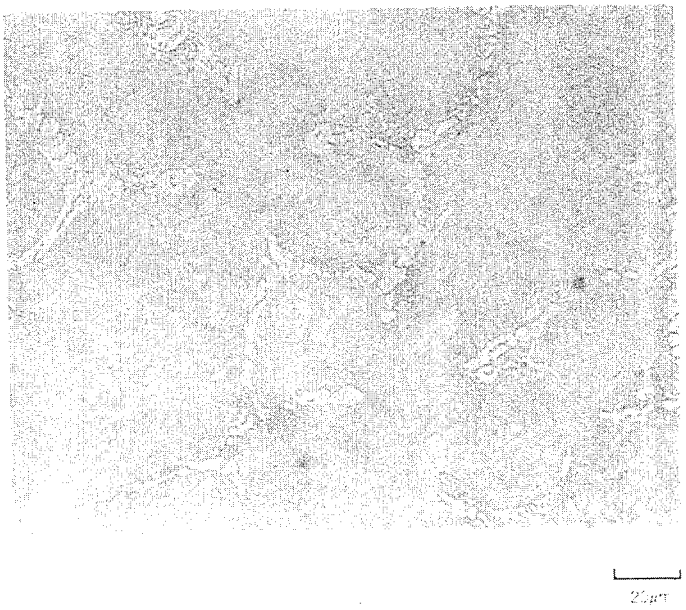

The standard braze cycle adversely affects the microstrucuture and properties of the as-cast alloy. The initial heat treatment at 1065° C. severely coarsens the $M_{23}C_6$ precipitates, thus leading to low yield stress of the standard brazed alloy at intermediate temperatures. The lack of age hardening after the first stage of 1065° C. is due to the initial rapid growth of the carbide particles into a very coarse dispersion, resulting in a weak structure. This effect is shown in FIG. 1. In addition, the aging of the second stage at about 790° C. precipitates more $M_{23}C_6$ so as to increase the alloy strength, but the large high temperature $M_{23}C_6$ precipitates are no longer available for strengthening the structure.

Figure 2A:
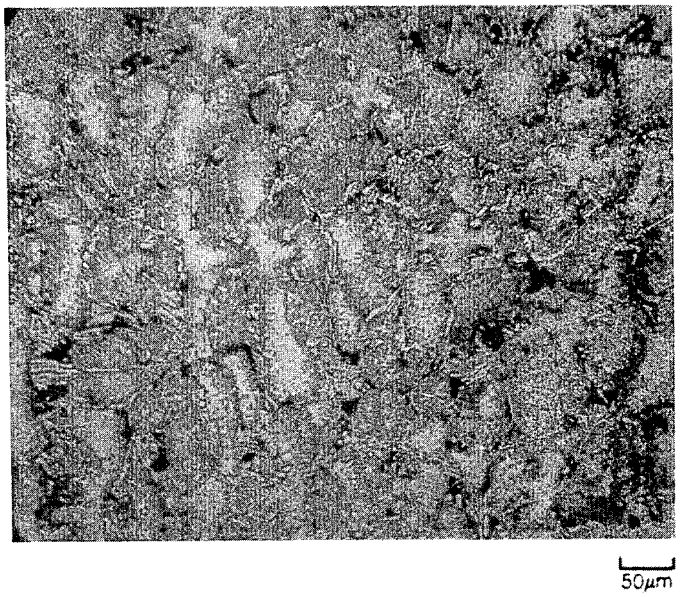
FIG. 2 is a micrograph of the as-cast alloy after it has been subjected to all three stages of the standard braze cycle heat treatment.
Figure 2B:
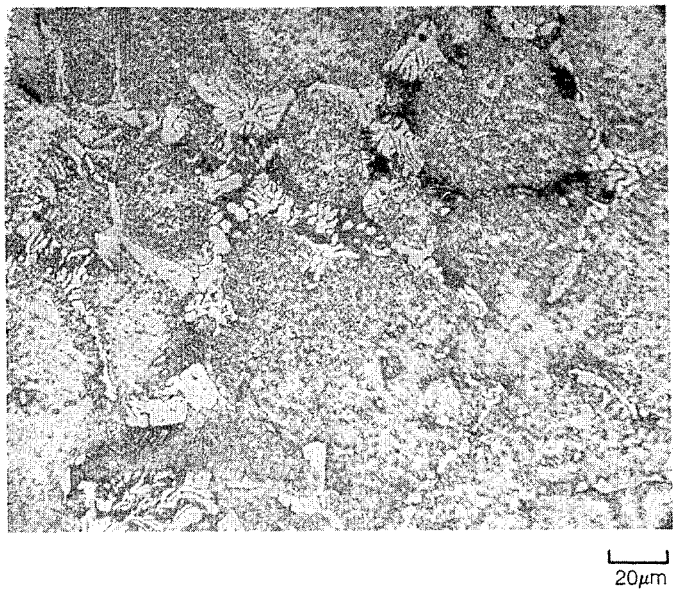

FIG. 2 illustrates the resultant micro-structure after the as-cast alloy has been subjected to all three stages of the standard braze cycle heat treatment. (The material to which the present alloy is brazed is CG-27 stainless steel for each of the braze cycle examples discussed). The resulting micro-structure is composed of the typical blocky $M_{23}C_6$ and script MC interconnected carbide structure with a dispersion of large $M_{23}C_6$ carbides within the austenitic interdendritic regions. Thus, it can be concluded that the standard braze cycle heat treatment is detrimental to the ambient and elevated temperature yield strength of the present alloy. To overcome this, a braze cycle above the $M_{23}C_6$ solvus is desirable.

Figure 3:
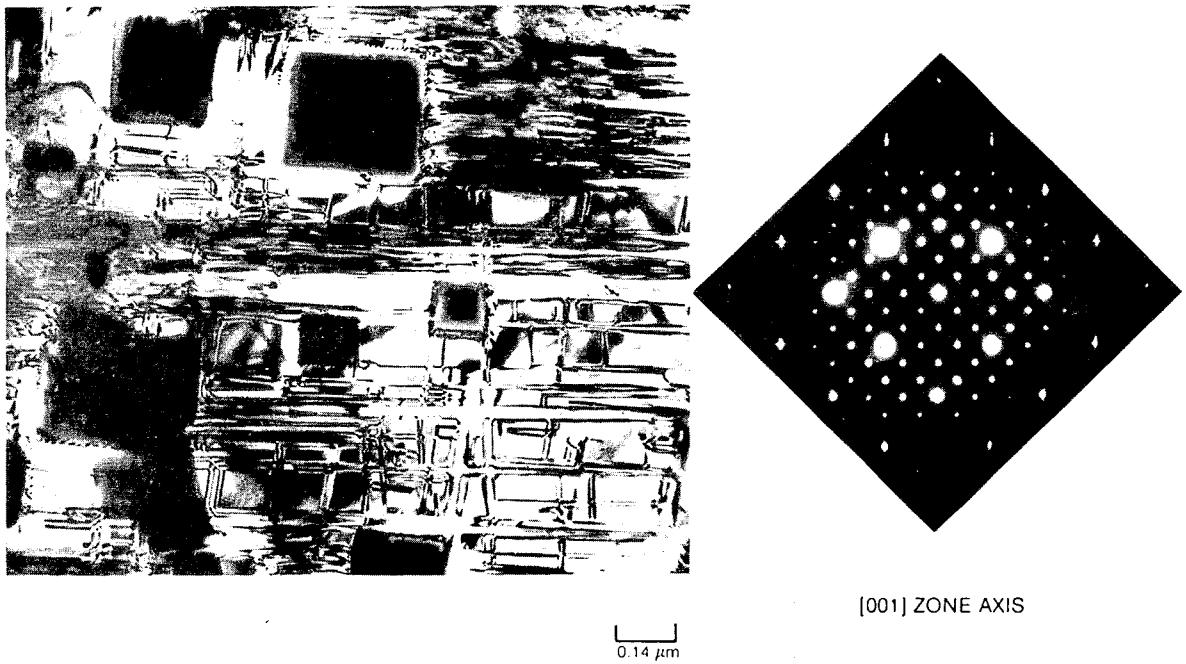
FIG. 3 is a Transmission Electron Microscope (TEM) micrograph of the as-cast alloy after it has been heat treated at about 870° C. for about 8 hours.

To increase the strength and ductility of the standard brazed material, the present underage prebraze heat treatment is conducted. This underage prebraze heat treatment precipitates a fine dispersion of $M_{23}C_6$ and results in a hardness of $R_c=46$. FIG. 3 shows an example of resulting fine planar features occurring as a result of an underage treatment (This underage treatment referred to in FIG. 3 consisted of heat treating the as-cast alloy at about 870° C. for about 8 hours). Thus, due to this underage prebraze treatment, the 1065° C. stage braze will not significantly affect the stabilized fine carbide dispersions.

Figure 4:
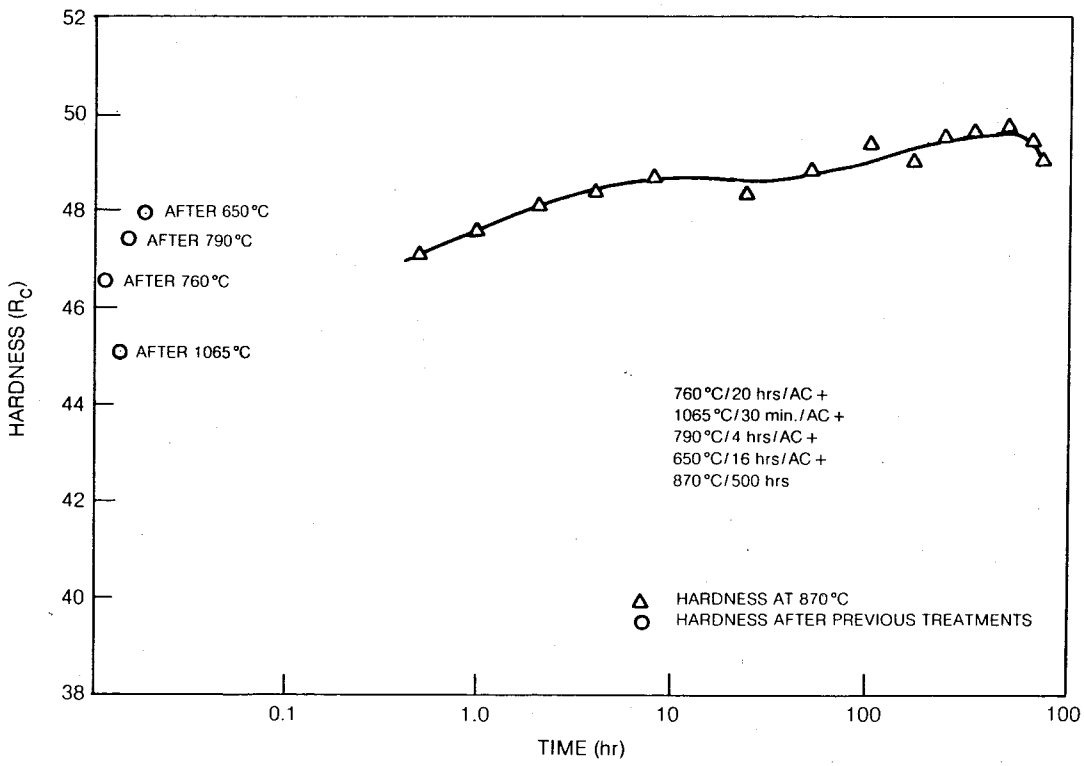
FIG. 4 is a plot of the age-hardening response at a temperature of 870° C. (to simulate a working enviroment) after the as-cast alloy has been subjected the underage prebraze cycle heat treatment combined with the standard braze cycle heat treatment.

The as-cast alloy was subjected to a prebraze heat treatment of 760° C./20 hours followed by cooling and the standard braze cycle heat treatment to determine the effects on the micro-structure and strength. Hardness measurements were made after each step in the heat treatment. Thereafter, specimens were continuously aged at 870° C. to simulate a working temperature. FIG. 4 depicts the results of these hardness measurements at each stage along the treatment and at the 870° C. environment.

Figure 5:
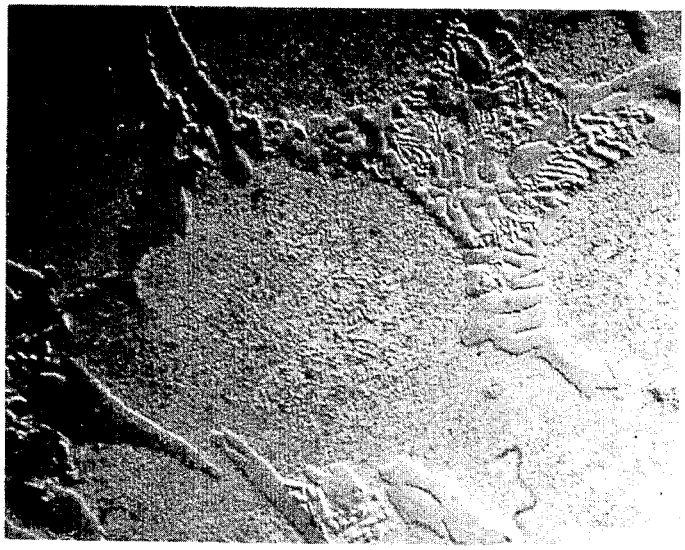
FIG. 5 is a micrograph of the micro-structure of the as-cast alloy after it has been subjected to the underage prebraze heat treatment and the first stage of the standard braze cycle heat treatment.
Figure 6:
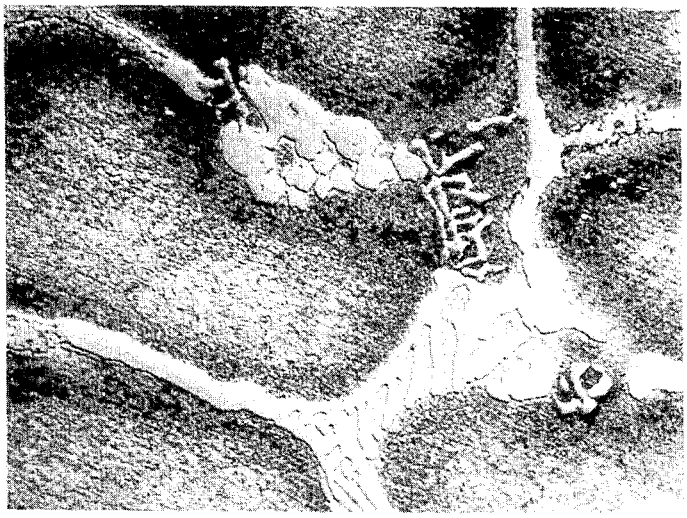
FIG. 6 is a micrograph of the micro-structure of the as-cast alloy after it has been subjected to the underage prebraze heat treatment and the first two stages of the standard braze cycle heat treatment.
Figure 7:
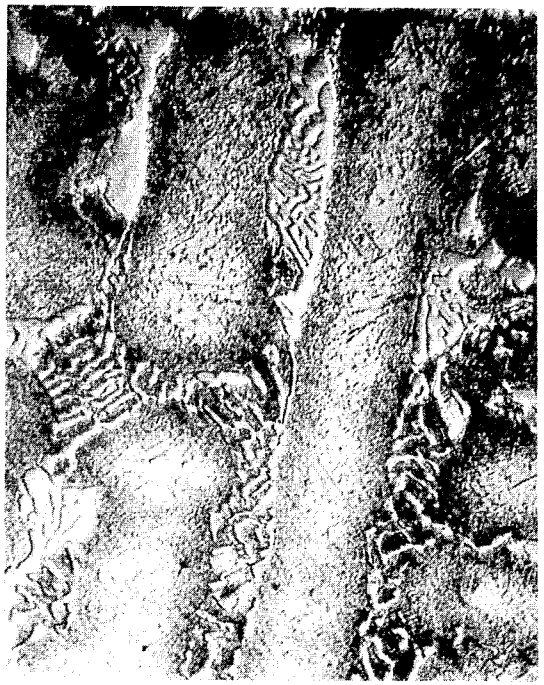
FIG. 7 is a micrograph of the micro-structure of the as-cast alloy after it has been subjected to the underage prebraze heat treatment and the standard braze cycle heat treatment.

The 870° C. exposure slightly strengthens the alloy through 500 hours of exposure. FIGS. 5–7 illustrate the micro-structural development through various stages of the underage prebraze and standard braze cycle. As shown, a fine carbide micro-structure exists after prebraze and the 1065° C. stage of the standard braze cycle (See FIG. 5). However, this fine uniform micro-structure is lost after the 650° C. stage (See FIG. 7). The hardness did not decrease, which suggests that the fine planar features described previously (FIG. 3) have formed and are strengthening the system.

Elevated temperature tensile tests were conducted on specimens subject to the standard braze cycle heat treatment, (1065° C./30 min/AC+790° C./16 hr/AC+650° C./16 hr/AC) and the underage prebraze treatment followed with the standard braze cycle heat treatment (760° C./20 hr/AC+1065° C./30 min/AC+790° C./16 hr/AC+650° C./16 hr/AC). The results are shown in Table 1.

TABLE I

| Sample | Test Temp. (°C.) | UTS MPa | .2% YS MPa | % Elongation | % RA |
|---|---|---|---|---|---|
| Elevated Temperature Tensile Test Results for underage prebraze followed by standard braze cycle | | | | | |
| 1 | RT | 717 | 623 | 0.55 | <0.10 |
| 2 | 400 | 630 | 512 | 1.2 | 0.33 |
| 3 | 600 | 518 | 405 | 1.1 | 0.80 |
| 4 | 800 | 351 | 281 | 9.6 | 16.0 |
| 5 | 900 | 220 | 187 | 12.3 | 50.0 |
| Elevated Temperature Tensile Test Results for standard braze cycle | | | | | |
| 1 | RT | 647 | 577 | 0.7 | 3.9 |
| 2 | 400 | 521 | 396 | 1.4 | 2.1 |
| 3 | 600 | 523 | 332 | 0.9 | 6.2 |
| 4 | 800 | 412 | 276 | 5.7 | 7.0 |
| 5 | 900 | 194 | 158 | 23.2 | 68.8 |

(% RA is a measurement of the reduction in the area of the test sample)

The results in Table I show that the tensile properties significantly improve as a result of the underage prebraze treatment combined with the standard braze cycle treatment. No loss in ductility with values of ~10% were obtained at intermediate temperatures.

Figure 8A:
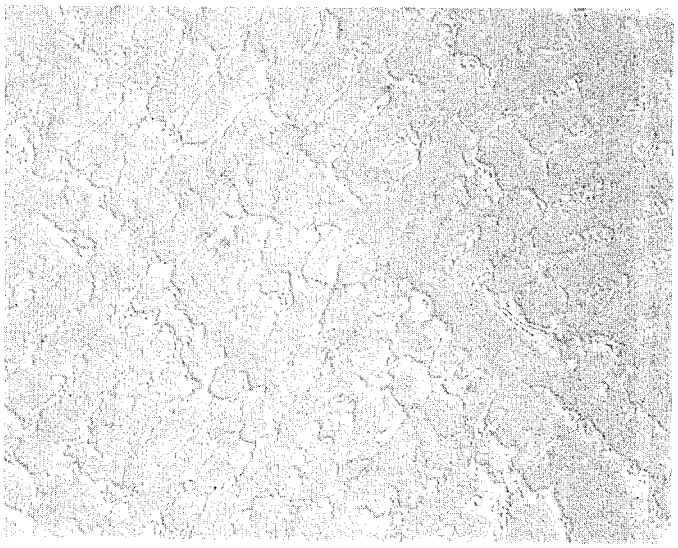
FIG. 8 is a micrograph of the micro-structure of the as-cast alloy after it has been subjected to the overage prebraze heat treatment and the standard braze cycle heat treatment.
Figure 8B:
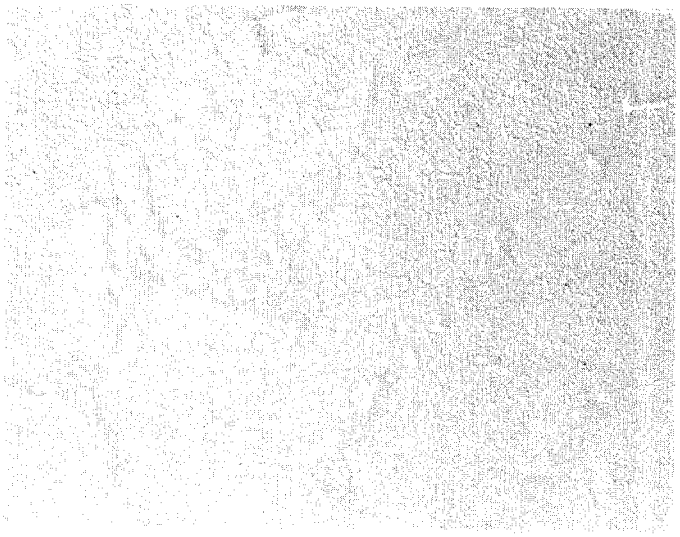

FIG. 8 is a micrograph of the micro-structure of the as-cast alloy after it has been subjected to the overage prebraze heat treatment followed by the standard braze cycle heat treatment. FIG. 8(*b*) shows a very coarse dispersion of $M_{23}C_6$, which is expected to result in a softer structure. Hardness readings indicate that the prebraze overage followed by the standard braze cycle treatment results in a hardness of $R_c=41.2$, as opposed to $R_c=45$ for the standard braze cycle alone.

Figure 9:
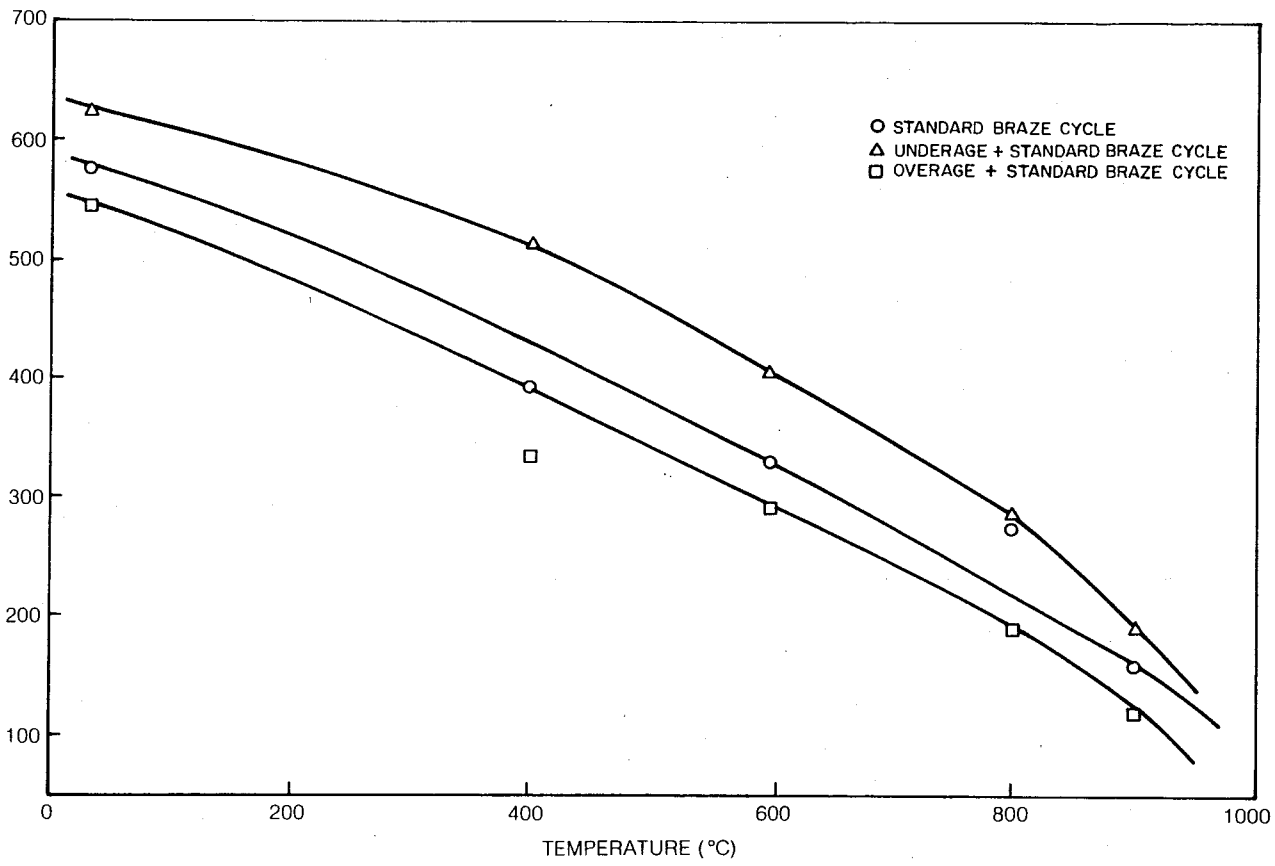
FIG. 9 is a plot of the 0.2% yield stress of the as-cast alloy after it has been subjected to the standard braze cycle heat treatment, the underage prebraze heat treatment followed by the standard braze cycle heat treatment, and the overage prebraze treatment followed by the standard braze cycle heat treatment.

Table II illustrates the results of tensile tests performed at various temperatures on samples subjected to the prebraze overage treatment combined with the standard braze cycle heat treatment (1150° C./10 hr/AC+1065° C./30 min/AC+790° C./16 hr/AC+650° C./16 hr/AC). The yield stresses are lower than for both the standard braze cycle heat treatment and the underage combined with the braze cycle heat treatment. FIG. 9 shows this effect better as it is a plot of 0.2% offset yield stress, Oy as a function of temperature for alloys obtained by all three heat treatments because the present heat treatment causes formation of $M_{23}C_6$ and planar defects, which result in low ductility. The ductility of the overaged plus braze alloy is, however, significantly enhanced as shown through the % elongation and % RA data. The ultimate strength of the overaged plus braze alloy is, however, significantly enhanced.

TABLE II

Elevated Temperature Tensile Test Results for overage prebraze followed by standard braze cycle

| Sample | Test Temp. (°C.) | UTS MPa | .2% YS MPa | % Elongation | % RA |
|---|---|---|---|---|---|
| 1 | RT | 608 | 544 | 0.4 | 0.1 |
| 2 | 400 | 500 | 336 | 1.0 | 0.1 |
| 3 | 600 | 482 | 290 | 1.6 | 0.8 |
| 4 | 800 | 253 | 189 | 8.7 | 25.3 |
| 5 | 900 | 157 | 121 | 32.5 | 47.7 |

The composition of the present alloy in the testing and examples discussed above was about 15% manganese, about 15% chromium, about 2% molybdenum, about 1.5% carbon, about 1% silicon, and about 1% niobium with the balance being iron.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A heat-treated cast austenitic stainless steel alloy consisting essentially of about 13–17% chromium, about 13–17% manganese, about 1.5–2.5% molybdenum, about 1.0–2.0% carbon, about 0.5–1.5% niobium, about 0.5–1.5% silicon, with the balance being iron, which is produced by the process comprising:

casting said alloy;

subjecting said alloy to a prebraze heat cycle treatment including heat treating said cast alloy at about 735°–785° C. for about 18–22 hours followed by cooling; and subjecting said alloy to a braze cycle heat treatment including:

a first stage heat treatment at about 1040°–1090° C. for about 20–40 minutes followed by cooling;

an optional second stage heat treatment at about 765°–815° C. for about 14–18 hours followed by cooling; and an optional third stage heat treatment at about 625°–675° C. for about 14–18 hours followed by cooling.

2. The heat-treated cast austenitic stainless steel alloy of claim 1, wherein said first stage heat treatment occurs at about 1065° C. for about 30 minutes, said second stage heat treatment occurs at about 790° C. for about 16 hours, and said third stage heat treatment occurs at about 650° C. for about 16 hours.

3. The heat-treated cast austenitic stainless steel allow of claim 1, wherein said prebraze heat treatment occurs at about 760° C. for about 20 hours.

4. The heat-treated cast austenitic stainless steel alloy of claim 2, wherein said prebraze heat treatment occurs at about 760° C. for about 20 hours.

5. The heat-treated cast austenitic stainless steel alloy of claim 1, wherein said alloy comprises about 15% chromium, about 15% manganese, about 2.0% molybdenum, about 1.5% carbon, about 1% niobium, about 1% silicon with the balance being iron.

6. A heat-treated cast austenitic stainless steel alloy consisting essentially of about 13–17% chromium, about 13–17% manganese, about 1.5–2.5% molybdenum, about 1.0–2.0% carbon, about 0.5–1.5% niobium, about 0.5–1.5% silicon, with the balance being iron, which is produced by the process comprising:

casting said alloy;

subjecting said alloy to a prebraze heat cycle treatment including heat treating said cast alloy at about 1125°–1175° C. for about 8–12 hours followed by cooling said alloy; and subjecting said alloy to a braze cycle heat treatment including:

a first stage heat treatment at about 1040°–1090° C. for about 20–40 minutes followed by cooling;

an optional second stage heat treatment at about 765°–815° C. for about 14–18 hours followed by cooling; and an optional third stage heat treatment at about 625°–675° C. for about 14–18 hours followed by cooling.

7. The heat-treated cast austenitic stainless steel alloy of claim 6, wherein said first stage heat treatment occurs at about 1065° C. for about 30 minutes, said second stage heat treatment occurs at about 790° C. for about 16 hours, and said third stage heat treatment occurs at about 650° C. for about 16 hours.

8. The heat-treated cast austenitic stainless steel alloy of claim 6, wherein said prebraze heat treatment occurs at about 1150° C. for about 10 hours.

9. The heat-treated cast austenitic stainless steel alloy of claim 7, wherein said prebraze heat treatment occurs at about 1150° C. for about 10 hours.

10. The heat-treated cast austenitic stainless steel alloy of claim 6, wherein said alloy comprises about 15% chromium, about 15% magnanese, about 2.0% molybdenum, about 1.5% carbon, about 1% niobium, about 1% silicon with the balance being iron.

11. A heat-treated cast austenitic stainless steel alloy consisting of about 13–17% chromium; about 13–17% manganese, about 1.5–2.5% molybdenum, about 1.0–2.0% carbon, about 0.5–1.5% niobium, about 0.5–1.5% silicon, and a balance of iron.

* * * * *